US008847871B2

(12) United States Patent
Lee et al.

(10) Patent No.: US 8,847,871 B2
(45) Date of Patent: Sep. 30, 2014

(54) TIMING CONTROL APPARATUS AND DISPLAY DEVICE HAVING THE SAME

(75) Inventors: Hyoung-Rae Lee, Cheonan-si (KR); Jae-Ho Jung, Cheonan-si (KR); Sang-Won Lee, Suwon-si (KR); Duk-Hwan Kang, Incheon (KR); Tae-Gwang Jung, Asan-si (KR); Ri-Na You, Seoul (KR)

(73) Assignee: Samsung Display Co., Ltd., Yongin (KR)

( * ) Notice: Subject to any disclaimer, the term of this patent is extended or adjusted under 35 U.S.C. 154(b) by 890 days.

(21) Appl. No.: 12/420,551

(22) Filed: Apr. 8, 2009

(65) Prior Publication Data

US 2010/0045588 A1 Feb. 25, 2010

(30) Foreign Application Priority Data

Aug. 22, 2008 (KR) ..... 10-2008-0082160

(51) Int. Cl.
*G09G 3/36* (2006.01)
*G09G 3/20* (2006.01)

(52) U.S. Cl.
CPC ..... *G09G 3/2096* (2013.01); *G09G 3/3677* (2013.01); *G09G 3/3688* (2013.01); *G09G 2330/021* (2013.01)
USPC ..... 345/99

(58) Field of Classification Search
None
See application file for complete search history.

(56) References Cited

U.S. PATENT DOCUMENTS

| | | | | |
|---|---|---|---|---|
| 7,123,252 | B1 * | 10/2006 | Baek | 345/213 |
| 7,132,689 | B2 * | 11/2006 | Ahn et al. | 257/72 |
| 7,196,679 | B2 * | 3/2007 | Jang et al. | 345/60 |
| 8,044,908 | B2 * | 10/2011 | Lee | 345/94 |

FOREIGN PATENT DOCUMENTS

| | | |
|---|---|---|
| CN | 101093649 | 12/2007 |
| JP | 2004-184457 | 7/2004 |
| JP | 2006-154808 | 6/2006 |
| KR | 19990041975 | 12/1999 |
| KR | 10-2002-0001471 | 1/2002 |
| KR | 10-2005-0037241 | 4/2005 |
| KR | 1020080001804 | 1/2008 |

* cited by examiner

*Primary Examiner* — Jason Olson
(74) *Attorney, Agent, or Firm* — H.C. Park & Associates, PLC

(57) ABSTRACT

A timing control apparatus includes a memory part, a multi-timing control part, and a power supply part. The memory part stores data. The multi-timing control part includes a plurality of timing controllers that sequentially read the stored data from the memory part in response to a reset signal, and outputs a power control signal that controls an output timing of a power. The power supply part outputs the power in response to the power control signal.

20 Claims, 3 Drawing Sheets

TIMING CONTROL APPARATUS AND DISPLAY DEVICE HAVING THE SAME

CROSS REFERENCE TO RELATED APPLICATION

This application claims priority from and the benefit of Korean Patent Application No. 2008-82160, filed on Aug. 22, 2008, which is hereby incorporated by reference for all purposes as if fully set forth herein.

BACKGROUND OF THE INVENTION

1. Field of the Invention

The present invention relates to a timing control apparatus and a display device having the timing control apparatus. More particularly, the present invention relates to a timing control apparatus and a display device having the timing control apparatus, which may reduce cost of production and decrease the size of a printed circuit board (PCB).

2. Discussion of the Background

Generally, a display device displays a recognizable image using data provided from an information processing device. A flat panel display (FPD) device has various characteristics such as smaller thickness, lighter weight, lower power consumption, and higher resolution than other types of display devices, and thus the FPD device has been widely used in various fields.

The FPD device includes a liquid crystal display (LCD) device and a plasma display panel (PDP), for example.

LCDs have various characteristics such as small thickness, light weight, low driving voltage, and low power consumption. Thus, LCDs are widely employed in electronic devices such as monitors, laptop computers, cellular phones, televisions, etc. The LCD device includes an LCD panel displaying an image using light transmissivity of the liquid crystal, a backlight assembly disposed under the LCD panel to provide light to the LCD panel, and a driving part being electrically connected to the LCD panel to control the LCD panel.

The driving part includes a timing control part, a data driving part, and a gate driving part. The timing control part outputs a data control signal and a gate control signal based on a control signal provided from the exterior. The data driving part outputs a data signal to the LCD panel in response to a data control signal. The gate driving part outputs a gate signal to the LCD panel in response to a gate control signal.

The driving part may further include a memory part that generates an initial driving signal. For example, the memory part may be an electrically erasable programmable read-only memory (EEPROM) that stores a driving signal such as extended display identification data (EDID).

A driving frequency that is higher than a common frequency may be used to display high-resolution images. For example, the display devices may operate using a frequency of 120 Hz or 240 Hz that is a multiplied from 60 Hz by a frame divider.

When the display device operates using the common frequency of 60 Hz, the display device may include a timing controller and an EEPROM. When the display device operates using the frequency of 120 Hz, the display device may include two timing controllers and two EEPROMs. Also, when the display device operates using the common frequency of 240 Hz, the display device may include four timing controllers and four EEPROMs.

Therefore, the display device using a high frequency may increase production cost and complicate circuit design due to an increased number of component parts. Also, the size of a printed circuit board (PCB) in the display device may be increased. When the display device uses a plurality of timing controllers, a malfunction may be caused by a timing deviation between timing controllers.

SUMMARY OF THE INVENTION

The present invention provides a timing control apparatus, and a display device having the timing control apparatus, that may reduce production cost, decrease printed circuit board (PCB) size, and reduce malfunctions by decreasing the number of component parts in the display device.

Additional features of the invention will be set forth in the description which follows, and in part will be apparent from the description, or may be learned by practice of the invention.

The present invention discloses a timing control apparatus includes a memory part, a multi-timing control part, and a power supply part. The memory part stores data. The multi-timing control part includes a plurality of timing controllers to sequentially read the stored data from the memory part in response to a reset signal, and to output a power control signal that controls an output timing of a power. The power supply part outputs the power in response to the power control signal.

The present invention also discloses a display device includes a timing control apparatus, a gate driving part, a data driving part, and a display panel. The timing control apparatus includes a memory part to store data for controlling an image display, a multi-timing control part having a plurality of timing controllers to sequentially read the stored data in response to a reset signal and to output a power control signal that controls an output timing of a power, and a power supply part to output the power in response to the power control signal. The gate driving part receives the power and outputs a gate signal in response to a gate control signal provided from the timing control apparatus. The data driving part receives the power and outputs a data signal in response to a data control signal provided from the timing control apparatus. The display panel displays an image based on the gate signal and the data signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
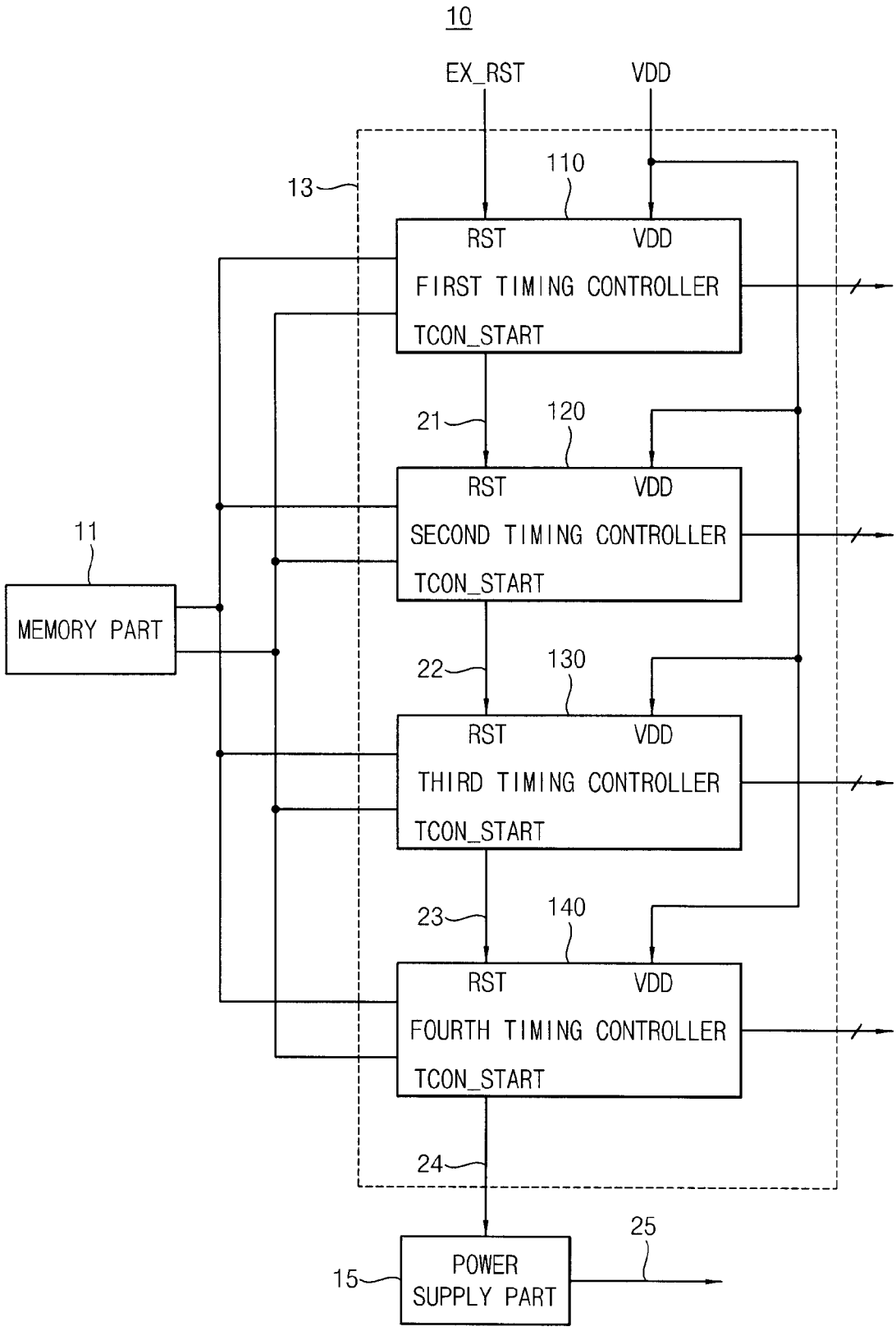
FIG. 1 is a block diagram showing a timing control apparatus in accordance with an exemplary embodiment of the present invention.

The present invention is described more fully hereinafter with reference to the accompanying drawings, in which exemplary embodiments of the present invention are shown. The present invention may, however, be embodied in many different forms and should not be construed as limited to the exemplary embodiments set forth herein. Rather, these exemplary embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the exemplary embodiments of present invention will be explained in detail with reference to the accompanying drawings.

FIG. 1 is a block diagram showing a timing control apparatus in accordance with an exemplary embodiment of the present invention.

Referring to FIG. 1, a timing control apparatus 10 includes a memory part 11, a multi-timing control part 13, and a power supply part 15. For example, the memory part 11 and the multi-timing control part 13 may be integrally mounted on a substrate. The memory part 11 and the multi-timing control part 13 may be integrated on an IC chip type to be integrally mounted on the substrate. For another example, the memory part 11, the multi-timing control part 13 and the power supply part 15 also may be integrally mounted on a substrate. The memory part 11, the multi-timing control part 13 and the power supply part 15 may be integrated on an IC chip type to be integrally mounted on the substrate.

The memory part 11 stores data. For example, the data may be for controlling an image display such as a clock signal CLK, a horizontal start signal STH, a vertical start signal STV, and a gamma reference voltage.

The memory part 11 may be an electrically erasable programmable read-only memory (EEPROM).

The memory part 11 provides the data to the multi-timing control part 13. The memory part 11 is written by connecting with a memory writer before finishing a product. The memory part 11 performs only a reading function after finishing the product.

The multi-timing control part 13 includes a plurality of timing controllers 110, 120, 130, and 140. The timing controllers 110, 120, 130, and 140 read the data from the memory part 11.

The multi-timing control part 13 includes the number of timing controllers that is substantially proportional to a multiple of a common frequency of about 60 Hz. For example, when the multi-timing control part 13 is employed in a display device and the display device operates using a frequency of about 120 Hz, the multi-timing control part 13 may include two timing controllers. When the display device operates using a frequency of about 240 Hz, the multi-timing control part 13 may include four timing controllers.

Hereinafter, an exemplary embodiment of the multi-timing control part 13 including four timing controllers to drive a display device using the frequency of about 240 Hz will be explained. The four timing controllers include a first timing controller 110, a second timing controller 120, a third timing controller 130, and a fourth timing controller 140.

The first to fourth timing controllers 110, 120, 130, and 140 receive a driving voltage VDD and reset signals RST and output timing control signals, respectively.

An external reset signal EX_RST is applied to only the first timing controller 110. The other timing controllers, that is, the second timing controller 120, the third timing controller 130, and the fourth timing controller 140 use start signals TCON_START of the preceding timing controller as the reset signals RST. A start signal TCON_START outputted from the last timing controller, that is, the fourth timing controller 140, is applied to the power supply part 15, and then the start signal controls an output timing of analog electric power 25 as a power control signal 24.

Figure 2:
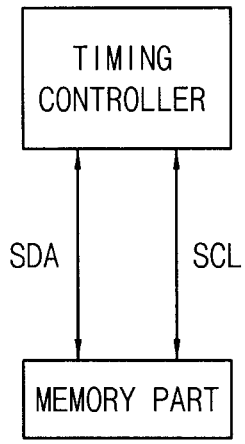
FIG. 2 is a block diagram showing a connection between the memory part and the timing controller in FIG. 1.

FIG. 2 is a block diagram showing a connection between the memory part and the timing controller in FIG. 1.

Referring to FIG. 1 and FIG. 2, each of the timing controllers 110, 120, 130, and 140 is connected to the memory part 11 by an inter-integrated circuit ($I^2C$) bus system using two signal lines. The signal lines may be a serial data (SDA) line and a serial clock (SCL) line.

When the external reset signal EX_RST is applied to the first timing controller 110, the first timing controller 110 resets data stored therein. Then, the first timing controller 110 sets new data by reading data for controlling an image display from the memory part 11 through the SDA line and the SCL line. After setting the data, the first timing controller 110 outputs a first start signal 21 to the second timing controller 120.

The first start signal 21 is used as the reset signal of the second timing controller 120. When the first start signal 21 is applied to the second timing controller 120, the second timing controller 120 resets data stored therein. Then, the second timing controller 120 sets new data by reading the data for controlling the image display from the memory part 11 through the SDA line and the SCL line. After setting the data, the second timing controller 120 outputs a second start signal 22 to the third timing controller 130.

The second start signal 22 is used as the reset signal of the third timing controller 130. When the second start signal 22 is applied to the third timing controller 130, the third timing controller 130 resets data stored therein. Then, the third timing controller 130 sets new data by reading the data for controlling the image display from the memory part 11 through the SDA line and the SCL line. After setting the data, the third timing controller 130 outputs a third start signal 23 to the fourth timing controller 140.

The third start signal 23 is used as the reset signal of the fourth timing controller 140. When the third start signal 23 is applied to the fourth timing controller 140, the fourth timing controller 140 resets data stored therein. Then, the fourth timing controller 140 sets new data by reading the data for controlling the image display from the memory part 11 through the SDA line and the SCL line. After setting the data, the fourth timing controller 140 outputs a fourth start signal 24, that is, the power control signal 24 controlling the output timing of the analog electric power 25, to the power supply part 15.

The power supply part 15 may be a direct current to direct current (DC-DC) converter. The power supply part 15 outputs the analog electric power 25 in response to the power control signal 24. For example, when the multi-timing control part 13 is used in the display device, the analog electric power 25 may include an analog driving voltage (AVDD), a gate on voltage (VON), a gate off voltage (VOFF), and a common voltage (VCOM).

The power supply part 15 outputs the analog electric power 25, and then each of the timing controllers 110, 120, 130, and 140 outputs the data set therein. When the multi-timing control part 13 is used in the display device, the outputted data may be a data control signal DCON and a gate control signal GCON.

Figure 3:
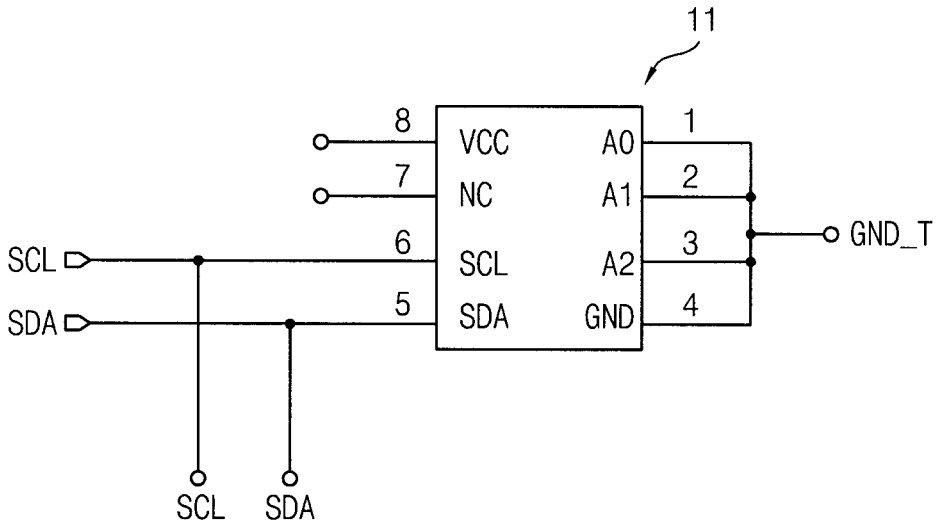
FIG. 3 is a block diagram showing an example of the memory part in FIG. 1.

FIG. 3 is a block diagram showing an example of the memory part 11 in FIG. 1.

Referring to FIG. 1, FIG. 2, and FIG. 3, the memory part 11 may be an EEPROM. The memory part 11 may include eight terminals. A first terminal A0, a second terminal A1, and a third terminal A2 are used as temporary terminals when additional data inputs or outputs, or additional functions, are performed. The first terminal A0, the second terminal A1, and the third terminal A2 are grounded before being used as a substitute terminal. A fourth terminal GND is a ground terminal of the memory part 11.

A fifth terminal SDA and a sixth terminal SCL input/output data by being connected to the timing controllers 110, 120, 130, and 140 through the SDA line and the SCL line. The SCL line is a one-way line transmitting a synchronizing clock for transmitting data. The SDA line is a two-way line for representing bit information of the transmitted data.

A seventh terminal NC to which data stored in the memory part 11 is applied is an input/output terminal. An eighth terminal VCC to which a power voltage is applied is an internal voltage terminal.

Figure 4:
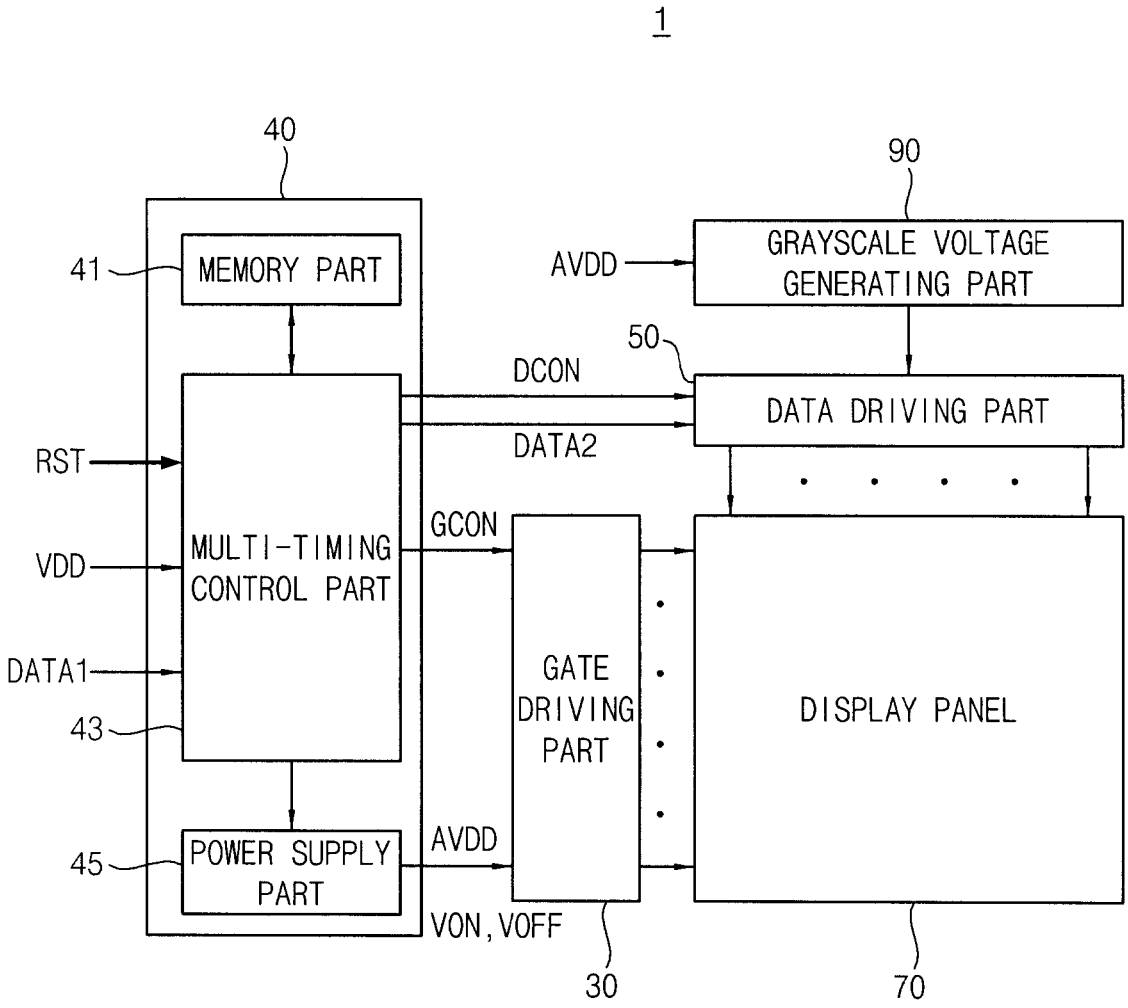
FIG. 4 is a block diagram showing a display device in accordance with an exemplary embodiment of the present invention.

FIG. 4 is a block diagram showing a display device in accordance with an exemplary embodiment of the present invention.

Referring to FIG. 4, a display device 1 includes a timing control apparatus 40, a gate driving part 30, a data driving part 50, and a display panel 70. The display device 1 may further include a grayscale voltage generating part 90 that generates grayscale voltages and outputs the grayscale voltages to the data driving part 50.

The timing control apparatus 40 receives a reset signal RST, a driving voltage VDD, and a first data signal DATA1 for displaying an image, and then the timing control apparatus 40 outputs a second data signal DATA2, which is a timing-controlled first data signal DATA1, a data control signal DCON, a gate control signal GCON, and analog electric power 25 that includes an analog driving voltage (AVDD), a gate on voltage (VON), a gate off voltage (VOFF), and a common voltage (VCOM).

Although not shown, the timing control apparatus 40 may further receive a vertical synchronizing signal (Vsync), a horizontal synchronizing signal (Hsync), and a data enable signal (DE). The vertical synchronizing signal (Vsync) represents a required time for displaying one frame. The horizontal synchronizing signal (Hsync) represents a required time for displaying one line. The data enable signal (DE) represents a time required to provide the pixels with the data.

The data control signal DCON may include a clock signal and a horizontal start signal (STH), which are not shown. The gate control signal GCON may include a vertical start signal (STV), which is not shown.

The gate driving part 30 outputs a gate signal according to the gate control signal GCON and the analog electric power 25 provided from the timing control apparatus 40. The gate driving part 30 may include one or more gate driving units. For example, when the display device 1 is driven by using a frequency of about 240 Hz, the gate driving part 30 may include eight gate driving units.

The data driving part 50 outputs a data signal according to the data control signal DCON and the analog electric power 25 provided from the timing control apparatus 40. The data driving part 50 may include one or more data driving units. For example, when the display device 1 is driven by using the frequency of about 240 Hz, the data driving part 50 may include sixteen data driving units.

The grayscale voltage generating part 90 generates grayscale voltages based on a reference voltage, which is the analog driving voltage (AVDD) of the analog electric power 25, and provides the grayscale voltages to the data driving part 50.

The display panel 70 displays an image based on the gate signal outputted from the gate driving part 30 and the data signal outputted from the data driving part 50.

The display panel 70 may be a liquid crystal display (LCD) panel including a first substrate, a second substrate, and a liquid crystal layer disposed between the first and second substrates to display the image. The LCD panel includes a plurality of pixels to display the image. Each pixel includes a switching element connected to a gate line and a data line, a liquid crystal capacitor electrically connected to the switching element, and a storage capacitor.

When the display panel 70 is the LCD panel, the display device 1 may further include a backlight assembly (not shown) disposed under the LCD panel to provide light to the LCD panel.

The timing control apparatus 40 includes a memory part 41, a multi-timing control part 43, and a power supply part 45. The timing control apparatus 40 is substantially the same as that of FIG. 1, and thus the same elements in FIG. 1 are referred to using similar reference numerals, and a further description of the timing control apparatus 40 will be omitted.

The memory part 41 is substantially the same as that of FIG. 2 and FIG. 3, and thus a further description of the memory part 41 will be omitted.

Referring to FIG. 1 and FIG. 4, the multi-timing control part 43 includes a plurality of timing controllers 110, 120, 130, and 140. The memory part 41 belongs commonly to the timing controllers 110, 120, 130, and 140.

The multi-timing control part 43 includes the number of timing controllers that is substantially proportional to a multiple of a common frequency of about 60 Hz. For example, when the display device 1 operates using a frequency of about 120 Hz, the multi-timing control part 43 may include two timing controllers. When the display device operates using a frequency of about 240 Hz, the multi-timing control part 43 may include four timing controllers.

Hereinafter, the exemplary embodiment of the multi-timing control part 43 including four timing controllers to drive the display device 1 using the frequency of about 240 Hz will be explained. The four timing controllers are a first timing controller 110, a second timing controller 120, a third timing controller 130, and a fourth timing controller 140.

The first to fourth timing controllers 110, 120, 130, and 140 commonly use the memory part 41. The first to fourth timing controllers 110, 120, 130, and 140 receive the driving voltage VDD and the first data signal DATA1 for displaying an image, and then output the data control signal DCON and the second data signal DATA2, which is a timing-controlled first data signal DATA1, to the data driving part 50, and outputs the gate control signal GCON to the gate driving part 30.

An external reset signal EX_RST is applied to only the first timing controller 110. The other timing controllers, that is, the second timing controller 120, the third timing controller 130, and the fourth timing controller 140 use start signals TCON_START of the preceding timing controller as the reset signals RST. A start signal outputted from the last timing controller, that is, the fourth timing controller 140, is applied to the power supply part 45, and then the start signal controls an output timing of analog electric power 25 by a power control signal 24.

When the external reset signal EX_RST is applied to the first timing controller 110, the first timing controller 110 resets data stored therein. Then, the first timing controller 110 sets new data by reading data for controlling an image display from the memory part 41 through the SDA line and the SCL line. After setting the data, the first timing controller 110 outputs a first start signal 21 to the second timing controller 120.

The first start signal 21 is used as the reset signal of the second timing controller 120. When the first start signal 21 is applied to the second timing controller 120, the second timing controller 120 resets data stored therein. Then, the second timing controller 120 sets new data by reading the data for controlling the image display from the memory part 41 through the SDA line and the SCL line. After setting the data, the second timing controller 120 outputs a second start signal 22 to the third timing controller 130.

The second start signal 22 is used as the reset signal of the third timing controller 130. When the second start signal 22 is applied to the third timing controller 130, the third timing controller 130 resets data stored therein. Then, the third timing controller 130 sets new data by reading the data for controlling the image display from the memory part 41 through the SDA line and the SCL line. After setting the data, the third timing controller 130 outputs a third start signal 23 to the fourth timing controller 140.

The third start signal 23 is used as the reset signal of the fourth timing controller 140. When the third start signal 23 is applied to the fourth timing controller 140, the fourth timing controller 140 resets data stored therein. Then, the fourth timing controller 140 sets new data by reading the data for controlling the image display from the memory part 41 through the SDA line and the SCL line. After setting the data, the fourth timing controller 140 outputs a fourth start signal 24, that is, the power control signal 24 controlling an output timing of the analog electric power 25, to the power supply part 45.

The power supply part 45 may be a DC-to-DC converter. The power supply part 45 outputs the analog electric power 25 in response to the fourth start signal 24. For example, the analog electric power 25 may include an analog driving voltage (AVDD), a gate on voltage (VON), a gate off voltage (VOFF), and a common voltage (VCOM).

The power supply part 45 outputs the analog electric power 25, and then each of the timing controllers 110, 120, 130, and 140 outputs the data set therein. The outputted data may be the data control signal DCON, the gate control signal GCON, and the second data signal DATA2.

For example, when the display device 1 is driven by using a frequency of about 240 Hz, the data driving part 50 may include sixteen data driving units and the gate driving part 30 may include eight gate driving units. The first to fourth timing controllers 110, 120, 130, and 140 may each control four data driving units. One of the first to fourth timing controllers 110, 120, 130, and 140 may control the eight gate driving units.

A timing control apparatus and a display device according to the present invention may reduce production cost and decrease the size of a printed circuit board (PCB), because a plurality of timing controllers commonly use one memory element. In addition, because a DC-DC converter outputs the analog electric power after all the timing controllers sequentially read the memory element, malfunctions caused by a timing deviation between the timing controllers may be reduced.

As described above, the plurality of timing controllers commonly use the same memory element so that the number of component parts and the size of the PCB may be decreased. Particularly, the number of memory elements may be reduced, so that production cost may be decreased and productivity may be increased by decreasing a writing time.

Furthermore, the timing controllers provide a reset signal to the next timing controller by being cascade-connected with each other, and thus malfunctions caused by timing deviation between the timing controllers may be decreased.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A timing control apparatus, comprising:

a memory part to store data;

a multi-timing control part comprising a plurality of timing controllers, each of the plurality of timing controllers being configured to sequentially read the stored data from the memory part in response to a reset signal, and to output a power control signal that controls an output timing of a power; and a power supply part to output the power in response to the power control signal, wherein the power control signal is outputted from a last timing controller in the timing controllers, and wherein the timing control apparatus is configured to drive a display panel at a frequency of 60*N Hz, N being a natural number not less than 2 and corresponding to the number of timing controllers.

2. The timing control apparatus of claim 1, wherein the timing controllers are cascade-connected with each other.

3. The timing control apparatus of claim 2, wherein the reset signal is applied to a first timing controller.

4. The timing control apparatus of claim 1, wherein the reset signal is applied to a first timing controller.

5. The timing control apparatus of claim 1, wherein the timing controllers comprise:

a first timing controller to read the stored data from the memory part in response to the reset signal and to output a first start signal; and a second timing controller to read the stored data from the memory part in response to the first start signal and to output a second start signal.

6. The timing control apparatus of claim 5, wherein the timing controllers further comprise;

a third timing controller to read the stored data from the memory part in response to the second start signal and to output a third start signal; and a fourth timing controller to read the stored data from the memory part in response to the third start signal.

7. The timing control apparatus of claim 6, wherein the fourth timing controller outputs the power control signal.

8. The timing control apparatus of claim 1, wherein each of the timing controllers is connected to the memory part by an inter-integrated circuit ($I^2C$) bus system.

9. The timing control apparatus of claim 1, wherein the memory part and the multi-timing control part are integrally mounted on a substrate.

10. A display device, comprising:

a timing control apparatus comprising a memory part to store data to control an image display, a multi-timing control part comprising a plurality of timing controllers, each of the plurality of timing controllers being configured to sequentially read the stored data in response to a reset signal and to output a power control signal to control an output timing of a power, and a power supply part to output the power in response to the power control signal;

a gate driving part to receive the power and to output a gate signal in response to a gate control signal provided from the timing control apparatus;

a data driving part to receive the power and to output a data signal in response to a data control signal provided from the timing control apparatus; and a display panel to display an image based on the gate signal and the data signal, wherein the power control signal is outputted from a last timing controller in the timing controllers, and wherein the timing control apparatus is configured to drive the display panel at a frequency of 60*N Hz, N being a natural number not less than 2 and corresponding to the number of timing controllers.

11. The display device of claim 10, wherein the timing controllers are cascade-connected with each other.

12. The display device of claim 11, wherein the gate driving part comprises a plurality of gate driving units and one of the timing controllers provides the gate control signal to the gate driving part.

13. The display device of claim 10, wherein the timing controllers comprise:

a first timing controller to read the stored data from the memory part in response to the reset signal and to output a first start signal; and a second timing controller to read the stored data from the memory part in response to the first start signal and to output a second start signal.

14. The display device of claim 13, wherein the timing controllers further comprise:

a third timing controller to read the stored data from the memory part in response to the second start signal and to output a third start signal; and a fourth timing controller to read the stored data from the memory part in response to the third start signal.

15. The display device of claim 14, wherein the fourth timing controller outputs the power control signal.

16. The display device of claim 15, wherein the display device is driven using a frequency of 240 Hz.

17. The display device of claim 15, wherein the data driving part comprises sixteen data driving units and the first timing controller, the second timing controller, the third timing controller, and the fourth timing controller provide the data control signal to each of four data driving units, respectively.

18. The display device of claim 17, wherein the gate driving part comprises eight gate driving units and one of the first timing controller, the second timing controller, the third timing controller, and the fourth timing controller provides the gate control signal to the eight gate driving units.

19. The timing control apparatus of claim 1, wherein the power supply part is configured to output the power after all of the plurality of timing controllers sequentially read the stored data from the memory part.

20. The display device of claim 10, wherein the power supply part is configured to output the power after all of the plurality of timing controllers sequentially read the stored data from the memory part.

* * * * *